US005407271A

United States Patent [19]

Jørgensen et al.

[11] Patent Number: 5,407,271

[45] Date of Patent: Apr. 18, 1995

[54] INTEGRATED ROTARY MIXER AND DISPERSER HEAD

[75] Inventors: Povl J. Jørgensen, Vedbaek; Knud E. J. Jensen, Horsholm, both of Denmark

[73] Assignee: Jorgen Jørgensen Maskinfabrik A/S, Copenhagen, Denmark

[21] Appl. No.: 133,745

[22] Filed: Oct. 7, 1993

[51] Int. Cl.[6] ..... B01F 5/12

[52] U.S. Cl. ..... 366/265; 241/46.17; 416/228

[58] Field of Search ..... 366/64, 241, 262–265, 366/270, 305, 342, 343; 416/92, 228, 231 A; 241/46.017, 46.11, 46.17, 79.2, 86

[56] References Cited

U.S. PATENT DOCUMENTS

| | | | |
|---|---|---|---|
| 2,193,686 | 3/1940 | Craddock | 416/228 |
| 2,461,720 | 2/1949 | Cawood et al. | 366/263 |
| 3,170,638 | 2/1965 | Burton | 241/46.17 X |
| 3,290,016 | 12/1966 | Lennon et al. | 416/228 |
| 4,490,049 | 12/1984 | Sanders et al. | 366/265 X |
| 4,515,482 | 5/1985 | Schadewald | 366/262 X |
| 4,900,159 | 2/1990 | Jamison | 366/262 X |

FOREIGN PATENT DOCUMENTS

| | | | |
|---|---|---|---|
| 306174 | 8/1971 | U.S.S.R. | 366/265 |

*Primary Examiner*—David A. Scherbel
*Assistant Examiner*—Charles Cooley
*Attorney, Agent, or Firm*—Dressler, Goldsmith, Shore & Milnamow, Ltd.

[57] ABSTRACT

A rotary mixer and disperser head consisting of a shaft to which is connected a mixing chamber that is to be disposed into a vat or the like for dispersing, dissolving or blending of solids liquids or gasses with other liquids. The mixing chamber has secured to its upper and lower ends a plurality of impeller blades that have an end thereof located outside the mixing chamber to direct material into the mixing chamber and out through openings in the side wall of the mixing chamber during the mixing and dispersing thereof. The shaft for rotating the mixing chamber is merely located at one end thereof and doesn't extend into the mixing chamber and thus does not impede the mixing action taking place therewithin. The specific location of the blades, their relationship relative to the mixing chamber and their configuration provide for a very efficient mixing operation.

3 Claims, 3 Drawing Sheets

INTEGRATED ROTARY MIXER AND DISPERSER HEAD

The present invention relates to an integrated rotary mixer and disperser head for operations such as dispersing, dissolving, emulsifying and blending of solids, liquids or gases with other liquids and more particularly of the type comprising a slotted mixing chamber with a shaft adapted to be connected to a rotatable drive shaft.

The mixer and disperser head according to the invention is particularly useful in the food-processing industry, the chemical industry, the pharmaceutical industry and other branches of industry for dispersing and dissolving of solids and semi-solids in liquids.

BACKGROUND ART

A mixer head of this type is marketed by Process Systems, Inc., Park Ridge, Ill., under the registered trade name Scott Turbon Mixer. This mixer head has a mixing chamber comprising two sections in the form of truncated cones; one at each end of a cylindrical middle section which is slotted along its periphery, and a central shaft extends through the mixer head. The conical sections act as centrifugal pumps pumping the substances to be mixed into the cylindrical section where in a first stage they undergo a hydraulic shear where the two streams meet. The slots in the middle section act in a second stage as specific shear elements, while a third shear stage occurs when the radial discharge from the head meet the slower moving contents of the mixing vessel. The shear forces act to mix the substances and in particular to disperse and dissolve solids in the fluid mixture.

Mixer heads of this type present several disadvantages. Thus, for a given diameter of the mixing chamber and a given rotational speed the throughput is delimited by the smaller cross sectional inlet areas of the conical sections. Further, in acting as centrifugal pumps the conical sections impart to the substances to be mixed a considerable tangential component of velocity which rather than to contribute to the hydraulic shear detracts therefrom. The central shaft extending through the mixing chamber reduces the volume thereof and thereby the retention time therein for the fluid mixture. Finally such mixer heads are not immediately accessible for ocular inspection after a cleaning-in-place procedure (CIP-procedure) due to the presence of the conical sections and the throughgoing shaft.

OBJECTS OF THE INVENTION

It is an object of the present invention to provide a rotary mixer and disperser head which has an improved performance relative to the prior art mixer heads and which includes at least one further stage of mixing wherein the substances to be mixed or to be dispersed undergo a mechanical shear.

It is a further object of the invention to provide a mixer and disperser head exerting improved hydraulic and mechanical shears to the substances to be mixed or dispersed.

It is another object of the invention to provide a mixer and disperser head having a mixing chamber with practically unobstructed inflow areas.

It is still another object of the invention to provide a mixer and disperser head having a mixing chamber with the greatest possible volume relative to its outer dimensions, thereby providing an optimum retention time for the fluid mixture.

It is a further object of the invention to provide a mixer and disperser head which lends itself to ocular inspection after a CIP-procedure.

It is a still further object of the invention to provide a mixer and disperser head which may be economically manufactured by means of a few simple and low-cost technological procedures.

DESCRIPTION OF THE INVENTION

According to the invention there is provided an integrated rotary mixer and disperser head comprising:

a shaft adapted to be connected to a rotatable drive shaft, a mixing chamber coaxial with and rigidly connected to said shaft, said mixing chamber being of generally cylindrical tubular shape and having through its peripheral walls a plurality of discharge openings such as equally angularly spaced elongated slots extending in a generally axial direction of the chamber, a first plurality of equally angularly spaced impeller blades at one axial end of said mixing chamber rigidly connecting said one end to said shaft, each of said first plurality of impeller blades having a leading edge disposed in spaced relation to and axially outside for said one end, and a trailing edge disposed axially inward for said leading edge, and a second plurality of equally angularly spaced impeller blades at the other axial end of said mixing chamber rigidly connected to said other end and to each other, each of said second plurality of impeller blades having a leading edge disposed in spaced relation to and axially outside said other end, and a trailing edge disposed axially inward from said leading edge.

By this construction of the mixer and disperser head the shaft is disposed completely outside the mixing chamber. The first and second pluralities of impeller blades impart from each end of the mixing chamber to the fluid mixture an inwardly directed thrust and a high velocity having a dominating axial component thereby creating an intense hydraulic shear in the fluid mixture. At the same time the impeller blades thereby also impart to each of the fluid streams a mechanical shear force further contributing to the mixing and dispersion of the fluid mixture. Due to the absence of the shaft from the mixing chamber it has a maximum volume providing for an optimum retention time for the fluid mixture therein. Further, the impeller blades only present a minor obstruction therefore an ocular inspection of the mixer and disperser head may easily be undertaken after a CIP-procedure.

It is preferred that each of said first plurality of impeller blades comprises a leading portion having a first part extending in a plane substantially perpendicular to the axis of the mixing chamber, the radially inner end whereof being rigidly connected to said shaft, and a second part bent about 90° inward from said first part and having its free end rigidly connected to said one axial end of the mixing chamber, and a trailing portion integral with and forming an obtuse angle with the first part of said leading portion and generally having the shape of a sector of an annulus.

It is likewise preferred that each of said second plurality of impeller blades comprises a leading portion having a first part extending in a plane substantially perpendicular to the axis of the mixing chamber, the radially inner end whereof being joined to the similar inner ends of the other impeller blades of said second plurality of impeller blades, and a second part bent about 90° inward from said first part and having its free and rigidly connected to said other axial end of the mixing chamber, and a trailing portion integral with and forming an obtuse angle with the first part of said leading portion and generally having the shape of a sector of an annulus.

In a preferred embodiment of the mixer and disperser head according to the invention at least some of said first and second pluralities of impeller blades have formations for creating turbulence or shear in a fluid mixture passing thereover. This further adds to the shear forces mechanically imparted to the fluid mixture by the impeller blades.

The said formations may preferably be indentations at the trailing edges of said impeller blades, and said indentations have a generally castellation-like people.

As another preferred feature the trailing edge of each of said plurality of elongated slots through the peripheral walls of said mixing chamber forms an acute angle with the tangent to the inside of said walls at the point of intersection. This feature adds further to the shear forces introduced in the fluid mixture as it leaves the inventive mixer and disperser head.

It is preferred that the various parts of the mixer and disperser head of the invention are made from a metallic material such as stainless steel and rigidly connected to each other by means of welding so as to form an integral one-piece unit.

DETAILED DESCRIPTION OF THE PREFERRED EMBODIMENT

Figure 1:
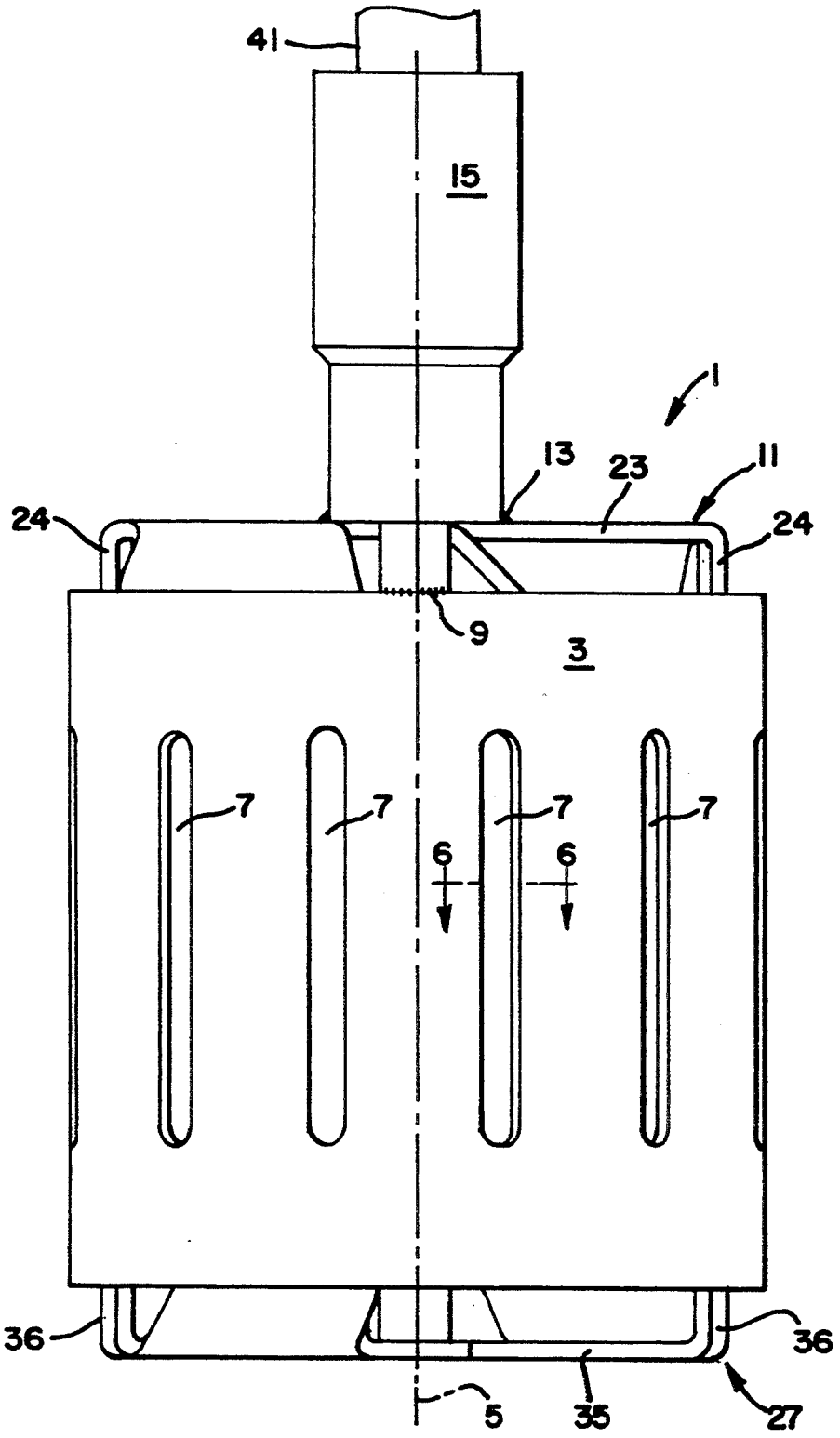
Figure 2:
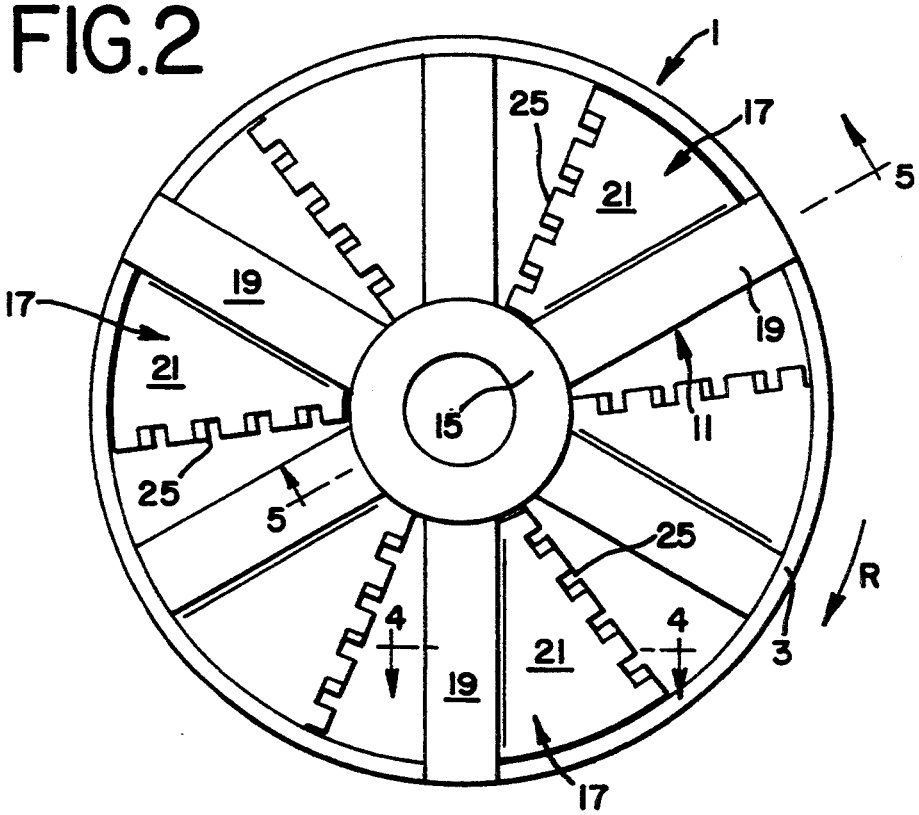
Figure 3:
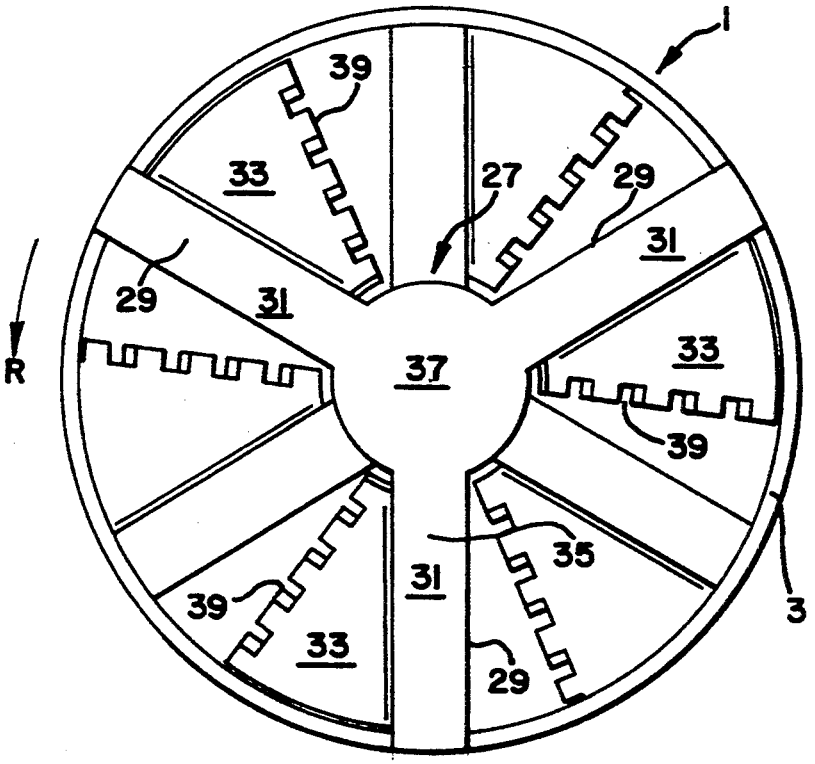
Figure 4:
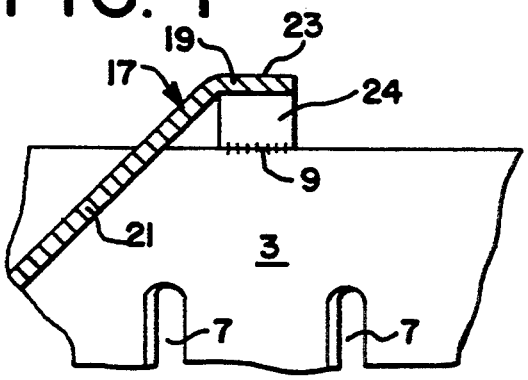
Figure 5:
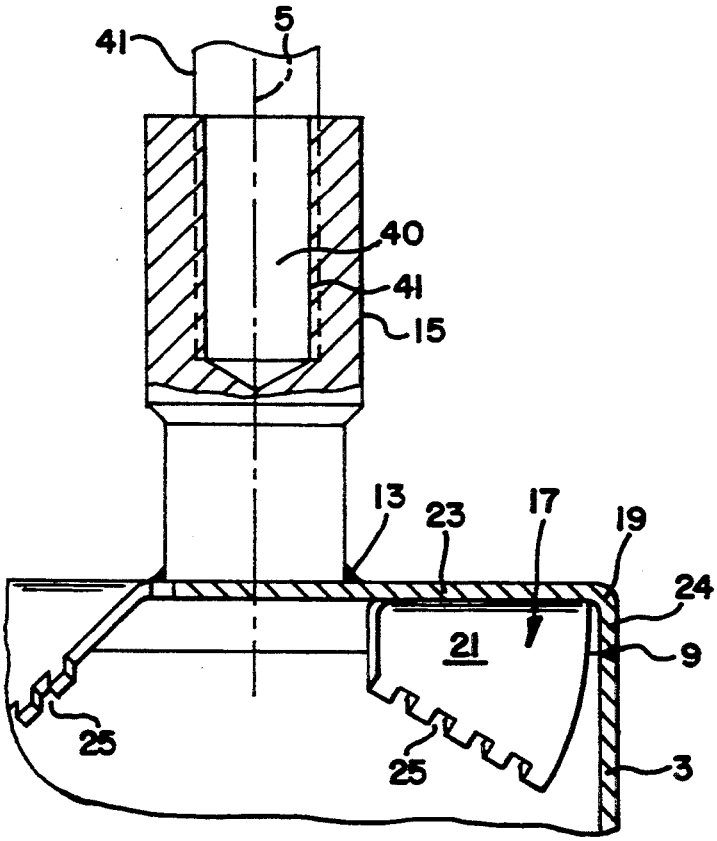
Figure 6:
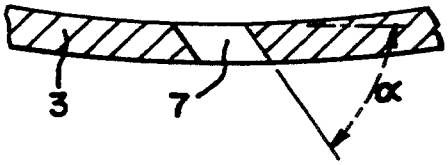

A preferred embodiment of the rotary mixer and disperser head according to the invention will in the following be described in more details with reference to the drawings wherein FIG. 1 shows the mixer and disperser head according to the invention in elevation, FIG. 2 shows a plan view of the mixer and disperser head of FIG. 1 as seen from above, FIG. 3 shows a plan view of the mixer and disperser head of FIGS. 1 and 2 as seen from below, FIG. 4 shows a broken cross sectional view along the line IV—IV in FIG. 2, FIG. 5 shows a broken cross sectional view along the line V—V in FIG. 2, and FIG. 6 shows in a somewhat greater scale a broken cross-sectional view generally along the line VI—VI in FIG. 1 through one of the elongated slots in the peripheral walls of the mixing chamber.

In FIGS. 1, 2 and 3, 1 generally indicates a rotary mixer and disperser head according to the invention. The mixer and disperser head 1 comprises a tubular mixing chamber 3 preferably made of stainless steel and having a circular cross section and a central axis 5. Spaced equally angularly through the walls of mixing chamber 3 in the axially middle region thereof are provided a plurality of axially extending alongated discharge slots 7.

Connected to the upper planar rim of mixing chamber 3 by weldings such as at 9 is a first set of impeller blades preferably made of stainless steel and generally indicated as 11, and connected to the first set of impeller blades 11 by welding such as at 13 is a shaft 15 also preferably of stainless steel and situated above the first set of impeller blades 11 and coaxial with the mixing chamber 3.

The first set of impeller blades 11 comprises three identical impeller blades 17 (see FIG. 2) disposed angularly offset by 120° for each other around the central axis 5. Each of the impeller blades 17 comprises a leading portion 19 (leading in the direction of rotation "R" of the mixer and disperser head 1) and a trailing portion 21. As best seen in FIGS. 4 and 5 the leading portion 19 of each of the impeller blades 17 has a first part 23 extending in a plane perpendicular to the axis 5, and a second part 24 bent inward about 90° from the first part 23 and connected by welding such as at 9 to the upper rim of the mixing chamber 3. The radially inner end of the first part 23 is connected to the shaft 15 by means of welding such as at 13. The trailing portion 21 forms as best seen in FIG. 4 an obtuse inward angle with the first part 23 of the leading portion 19 and has the shape of a sector of an annulus. Its trailing edge has indentations in the form of castellations 25.

Connected to the lower planar rim of mixing chamber 3 is a second set of impeller blades preferably made of stainless steel and generally indicated as 27. The second set of impeller blades 27 is a mirror image of the first set of impeller blades 11 and is offset relative thereto by 60° in the direction "R" of rotation of the mixer and disperser head 1. This second set of impeller blades 27 will therefore only be described in outlines in the following since more detailed information thereon may be had from the foregoing description of the first set of impeller blades 11 in connection with FIGS. 2, 4 and 5.

As best seen in FIG. 3 the second set of impeller blades 27 comprises three identical impeller blades 29 angularly offset by 120° for each other about the central axis 5. Each impeller blade 29 comprises a leading portion 31 and a trailing portion 33. The leading portion 31 has a radially inner first part 35 extending in a plane perpendicular to the axis 5 and a radially outer second part 36 bent about 90° inward from the first part 35. The radially inner parts 35 of the three impeller blades 29 are joined in a hub-like central disc 37, and the free ends of the bent parts 36 are connected so as by welding to the lower rim of the mixing chamber 3. The trailing portion 33 of each impeller blade 29 forms an obtuse inward angle with the first part 35 of the leading portion 31 and has the shape of a sector of an annulus. Its trailing edge has indentations in the form of castellations 39.

From the foregoing description of the first and second sets of impeller blades 11 and 27, respectively, it will easily be understood that they may be made from flat sheet metal by punching using the same set of dies, and by bending trailing portions 21 and bent parts 24 to one side to obtain a set of impeller blades 11 and trailing portions 33 and bent parts 36 to the opposite side to obtain a set of impeller blades 27.

As will be seen from FIG. 6 the slots 7 through the peripheral walls of mixing chamber 3 are not made as generally radial extending slots through said walls but are made such as by milling so that the middle plane through slot 7 forms an angle with a radial plane and more particularly so that the trailing edge of slot 7 forms an acute angle with the tangent to the inside wall at the point of intersection.

As explained initially herein this feature contributes to the shear forces introduced into the fluid mixture expelled through slots 7. The trailing edges of slots 7 so formed also enhance the centrifugal pumping action of the mixing chamber 3 by increasing the velocity by which the fluid mixture is expelled from the mixing chamber into the liquid mixture in the surrounding vessel thereby also increasing the hydraulic shear obtained thereby.

As shown in FIG. 5 the shaft 15 has a central bore 40 therein provided with an internal thread 41 adapted to be threadingly engaged with a corresponding external thread on a drive shaft 41 connected to a drive unit such as an electric motor or a hydraulic or pneumatic motor for rotatably driving the mixer and disperser head 1.

OPERATION OF THE MIXER AND DISPERSER HEAD ACCORDING TO THE INVENTION

When thus connected to a drive unit the mixer and disperser head 1 is immersed into the substances to be mixed and/or dispersed contained in a suitable vessel and caused to rotate at high RPM.

The first and second sets of impeller blades 11 and 27, respectively, now act as impeller pumps driving the substances from the surrounding vessel in a mainly axial direction into the mixing chamber 3 at a great velocity. Thereby the said substances firstly undergo an abrupt change of relative direction of movement resulting in the introduction of accelerative shear forces therein, secondly the flowing substances are further split up by the castellated indentations 25 and 39, respectively, introducing further turbulence and shear therein. Within the mixing chamber 3 the two streams of substances collide substantially axially at high velocities creating a high hydraulic shear. Due to the absence of a high speed rotating shaft there is no rotative force in the centre of the mixing chamber acting upon the substances. Therefore, the greater part of the substances move toward the periphery in a mainly non-rotative, radial direction whereby—during the expellation of the substances through the discharge slots—the high speed rotating slots act upon the slower moving substances with high mechanical shear. The substances are expelled therefrom with high velocity into the surrounding mixture, whereby they undergo further high hydraulic shear.

As compared with the initially mentioned prior art mixer heads this means that shear forces are introduced in the fluid mixtures in at least one further stage of the operation and intensified in the others resulting in an improved over-all performance.

Since the visibility of the inner surfaces of the mixer and disperser head according to the invention is only slightly obscured by the presence of the two sets of impeller blades 11 and 27, respectively, the inventive mixer and disperser head lends itself to an ocular inspection after a CIP-procedure.

From the foregoing description it will be understood that the various parts of the mixer and disperser head according to the invention may be manufactured at a low cost by simple technological processes and interconnected by welding so as to form an integrated one-piece unit.

While the foregoing description relates to the preferred embodiment it will be understood that numerous modifications may be incorporated therein without departing from the inventive concept. Thus the discharge openings may have any other appropriate shape than that of axially extending elongated slots, and also the impeller blades may be present in another number than three for each set of impeller blades and may have another shape than that described. Depending on the intended application of the mixer and disperser head it may also be made from other materials than stainless steel, e.g. from plastics materials, or from a combination of plastics materials and metallic materials, and the various parts of the mixer and disperser head may be rigidly connected to each other by other means than welding, e.g. by adhesive bonding.

What we claim is:

1. An integrated rotary mixer and disperser head comprising:

a shaft having an axis of rotation adapted to be connected to a rotatable drive shaft, a mixing chamber coaxial with and rigidly connected to said shaft, said mixing chamber being of a generally cylindrical tubular shape and having through its peripheral wall a plurality of discharge openings including equally angularly spaced elongated slots extending in a generally axial direction of said chamber, a first plurality of equally angularly spaced impeller blades at one axial end of said mixing chamber rigidly connecting said one end to said shaft which shaft is situated completely outside said mixing chamber, each of said first plurality of impeller blades having a leading edge disposed in spaced relation to and axially outside said one end of the mixing chamber, and a trailing edge disposed axially inward said one end of the mixing chamber, each of said first plurality of impeller blades comprises a leading portion having a first part extending in a plane substantially perpendicular to the axial direction of the mixing chamber, the radially inner end of the first plurality of impeller blades being rigidly connected to said shaft, and a second part bent about 90° inward from said first part, the second part of the first plurality of blades being rigidly connected to said one end of the mixing chamber, each of said first plurality of impeller blades including a trailing portion integral with and forming an obtuse angle with the first part of said leading portion and generally having the shape of a sector of an annulus, and a second plurality of equally angularly spaced impeller blades at the other axial end of said mixing chamber rigidly connected to said other end and to each other, each of said second plurality of impeller blades having a leading edge disposed in spaced relation to and axially outside said other end of the mixing chamber, and a trailing edge disposed axially inward said other end of the mixing chamber.

2. An integrated rotary mixer and disperser head comprising:

a shaft having an axis of rotation adapted to be connected to a rotatable drive shaft, a mixing chamber coaxial with and rigidly connected to said shaft, said mixing chamber being of a generally cylindrical tubular shape and having through its peripheral wall a plurality of discharge openings including equally angularly spaced elongated slots extending in a generally axial direction of said chamber, a first plurality of equally angularly spaced impeller blades at one axial end of said mixing chamber rigidly connecting said one end to said shaft which shaft is situated completely outside said mixing chamber, each of said first plurality of impeller blades having a leading edge disposed in spaced relation to and axially outside said one end of the mixing chamber, and a trailing edge disposed axially inward said one end of the mixing chamber and a second plurality of equally angularly spaced impeller blades at the other axial end of said mixing chamber rigidly connected to said other end and to each other, each of said second plurality of impeller blades having a leading edge disposed in spaced relation to and axially outside said other end of the mixing chamber, and a trailing edge disposed axially inward said other end of the mixing chamber, each of said second plurality of impeller blades comprises a leading portion having a first part extending in a plane substantially perpendicular to the axial direction of the mixing chamber, the radially inner end of the second plurality of impeller blades being joined to the radially inner ends of the other impeller blades of said second plurality of impeller blades, and a second part bent about 90° inward from said first part, the second part of the second plurality of blades being rigidly connected to said other end of the mixing chamber each of said second plurality of impeller blades including a trailing portion integral with and forming an obtuse angle with the first part of said leading portion and generally having the shape of a sector of an annulus.

3. An integrated rotary mixer and disperser head comprising:

a shaft having an axis of rotation adapted to be connected to a rotatable drive shaft, a mixing chamber coaxial with and rigidly connected to said shaft, said mixing chamber being of a generally cylindrical tubular shape and having through its peripheral wall a plurality of discharge openings including equally angularly spaced elongated slots extending in a generally axial direction of said chamber, a first plurality of equally angularly spaced impeller blades at one axial end of said mixing chamber rigidly connecting said one end to said shaft which shaft is situated completely outside said mixing chamber, each of said first plurality of impeller blades having a leading edge disposed in spaced relation to and axially outside said one end of the mixing chamber, and a trailing edge disposed axially inward said one end of the mixing chamber, each of said first plurality of impeller blades comprises a leading portion having a first part extending in a plane substantially perpendicular to the axial direction of the mixing chamber, the radially inner end of the first plurality of impeller blades being rigidly connected to said shaft, and a second part bent about 90° inward from said first part, the second part of the first plurality of blades being rigidly connected to said one end of the mixing chamber, each of said first plurality of impeller blades including a trailing portion integral with and forming an obtuse angle with the first part of said leading portion and generally having the shape of a sector of an annulus, and a second plurality of equally angularly spaced impeller blades at the other axial end of said mixing chamber rigidly connected to said other end and to each other, each of said second plurality of impeller blades having a leading edge disposed in spaced relation to and axially outside said other end of the mixing chamber, and a trailing edge disposed axially inward said other end of the mixing chamber, each of said second plurality of impeller blades comprises a leading portion having a first part extending in a plane substantially perpendicular to the axial direction of the mixing chamber, the radially inner end of the second plurality of impeller blades being joined to the radially inner ends of the other impeller blades of said second plurality of impeller blades, and a second part bent about 90° inward from said first part, the second part of the second plurality of blades being rigidly connected to said other end of the mixing chamber, each of said second plurality of impeller blades including a trailing portion integral with and forming an obtuse angle with the first part of said leading portion and generally having the shape of a sector of an annulus.

* * * * *